United States Patent [19]

Boyer

[11] Patent Number: 4,768,416

[45] Date of Patent: Sep. 6, 1988

[54] STRINGED INSTRUMENT DISPLAY ATTACHMENT

[76] Inventor: David J. Boyer, R.D. #2, Box 70, Addison, N.Y. 14801

[21] Appl. No.: 72,440

[22] Filed: Jul. 13, 1987

[51] Int. Cl.[4] ..... G10G 7/00

[52] U.S. Cl. ..... 84/453; 40/642

[58] Field of Search ..... 84/453, 471 R, 267 R, 84/464, 464 A, 478, 485 R; 40/10 R, 11 R, 13, 20 A, 584, 908

[56] References Cited

U.S. PATENT DOCUMENTS

| | | | |
|---|---|---|---|
| 1,054,192 | 2/1913 | Geddes | 40/11 R |
| 1,551,880 | 9/1925 | Holman | 40/11 R |
| 4,261,121 | 4/1981 | Coon | 40/11 R |
| 4,593,824 | 6/1986 | Pfeifer | 40/10 R X |

OTHER PUBLICATIONS

Kay Musical Instrument Co. brochure, 1964.

*Primary Examiner*—L. T. Hix
*Assistant Examiner*—Brian W. Brown

[57] ABSTRACT

Disclosed is a display attachment device for use in combination with a stringed instrument having a neck, a head having tuning pegs, a bridge at the junction of the neck and head and a plurality of strings, one of which bridges the space between each of the pegs and the bridge. The attachment means comprises a display plate and means for releasably securing the plate to the head. Means may be situated between the attachment means and the plate for spacing the plate above the head. A plurality of attachment devices are disclosed.

16 Claims, 3 Drawing Sheets

STRINGED INSTRUMENT DISPLAY ATTACHMENT

BACKGROUND OF THE INVENTION

1. Field of the Invention

This invention relates to display attachments for stringed instruments and more particularly to display attachments that can be removably attached to the instrument head.

2. Objects of the Invention

An object of the present invention is to provide an attachment device for enhancing the appearance of a stringed instrument such as a guitar. Another object is to provide the above-described device with means for quickly disconnecting it from an instrument.

SUMMARY OF THE INVENTION

The present invention broadly relates to a display attachment device for use in combination with a stringed instrument having a neck, a head having tuning pegs, a bridge located at the junction between the neck and head, and a string bridging the space between each of the pegs and the bridge. The attachment device comprises a display plate and means for releasably securing the plate to the head. Means may be situated between the attachment means and the plate for spacing the plate a sufficient distance above the head that the plate is situated on or above the pegs and strings.

DESCRIPTION OF THE PREFERRED EMBODIMENTS

Figure 1:
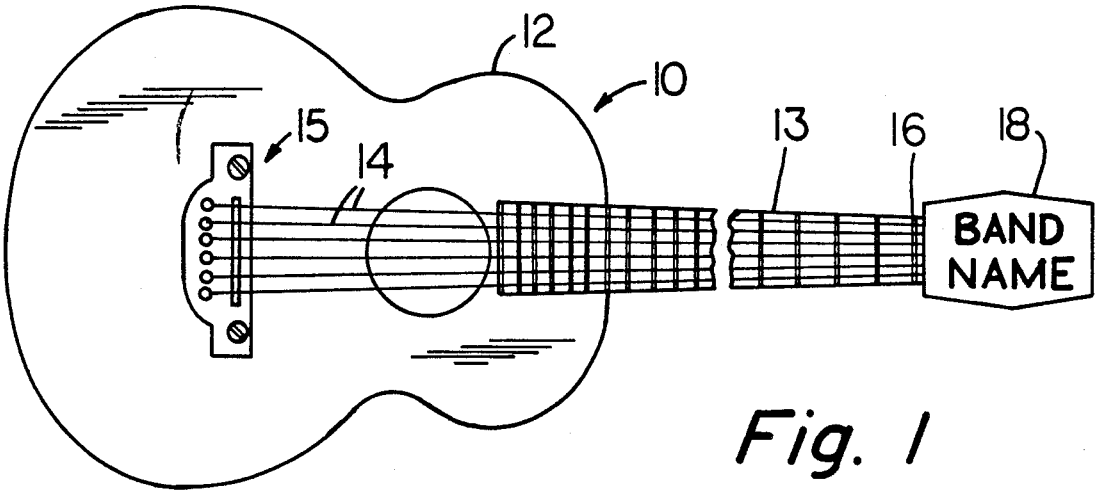
FIG. 1 is a front veiw of a guitar having a display attachment affixed to the head thereof.

FIG. 1 shows a stringed instrument 10 such as a guitar comprising a hollow body 12 and a neck 13. Although a guitar 10 is specifically illustrated, the present invention also applied to other stringed instruments such as banjos, mandolins and the like. A bridge 16 is situated between neck 13 and a head (not shown). Strings 14 span the distance between bridge 16 and bridge assembly 15. In accordance with the present invention a display attachment comprising plate 18 is releasably secured to the head. Appearing on display plate 18 can be the name of the artist that plays the instrument and/or such other information as the name of the group. It can be formed in any desired shape, and it can be decorated in any fashion desired for added beauty and style. It could also be lighted by means such as self-contained, mineature battery-operated lights.

The basic requirements for the display attachment device are (a) that it should not interfere with the operation of the instrument and (b) that it should easily release from the instrument or that it should be easily moved from its normal position over the strings. Requirement (a) is met by appropriately locating the support brackets on the instrument and by providing appropriate spacing means for causing the display sign to be suitably located with respect to the strings and tuning pegs. Requirement (b) is met by employing attachment means that releasably secure the display sign to the instrument or which secures the display sign in such a manner that it can be pivoted or moved away from the strings and tuning pegs.

Figure 2:
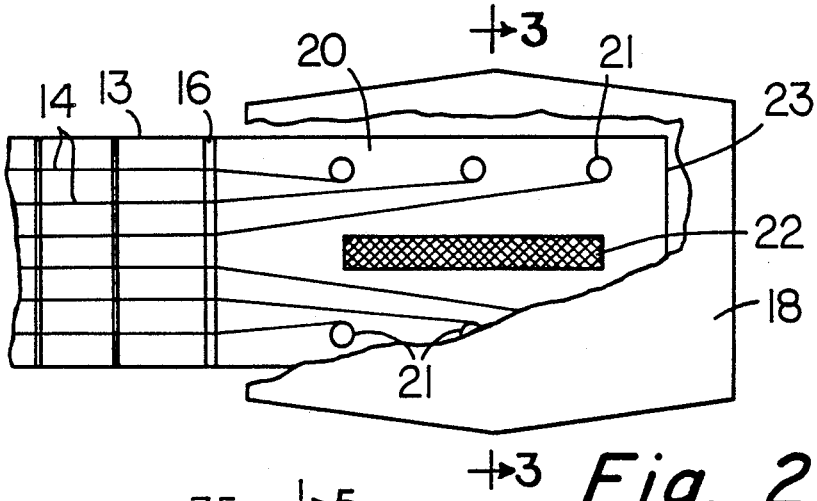
FIG. 2 is a front view of the head of a guitar in combination with a first display attachment means.
Figure 3:
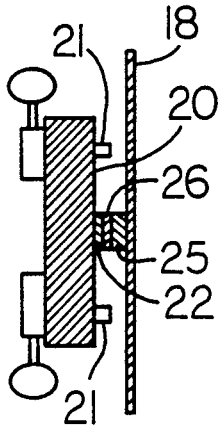
FIG. 3 is a cross-sectional view taken along lines 3—3 of FIG. 2.

A simple and inexpensive attachment means is shown in FIGS. 2 and 3. Display plate 18 is broken away in FIG. 2 to reveal head 20 having tuning pegs 21 protruding therethrough. Strings 14, which are equally spaced at bridge 16, are wound around pegs 21. Therefore, the two centrally located strings are spaced a distance that is sufficient to permit a strip 22 of a synthetic material to be glued or otherwise affixed to the central portion of the front face of head 20. Display plate 18 must be spaced a sufficient distance from head 20 that it is located on or above tuning pegs 21. Therefore, a spacer bar 25 is affixed to plate 18, and a second strip 26 of synthetic adherent material is affixed to bar 25. The material from which strips 22 and 26 are formed is such that they adhere when pressed together. Velcro brand synthetic material is suitable. Various parts can be adhered to one another by means such as glue, double-sided stickey tape or the like. Initially, strip 22 is adhered to head 20, and strip 26 is adhered to plate 18. Strip 26 is merely placed into contact with strip 22 in order to secure plate 18 to head 20. If a broken string has to be replaced or if it becomes desirable to replace plate 18 with another plate, plate 18 is lifted from head 20 and strips 22 and 26 become separated.

In the embodiment of FIGS. 2 and 3, reference has been made to tuning pegs which protrude through the head and to spacer means for locating plate 18 on or above tuning pegs 21. It is noted that on some guitars such as that illustrated in FIG. 16, the tuning pegs are recessed in the head. In such an embodiment, the spacer means, if any is employed, merely located the display plate on or above the uppermost part on the head. This might be the strings in that embodiment where the tuning pegs are recessed in the head.

Figure 4:
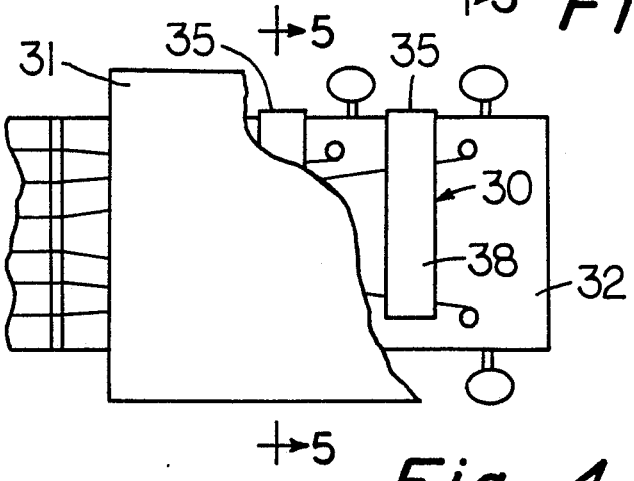
FIG. 4 shows a guitar head having another display attachment means.
Figure 5:
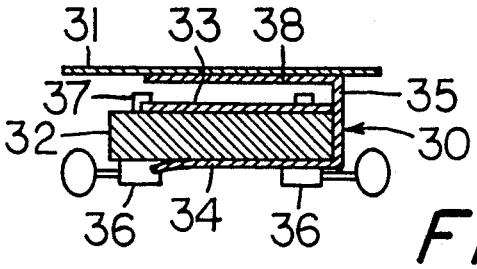
FIG. 5 is a cross-sectional veiw taken along lines 5—5 of FIG. 4.

In the embodiment shown in FIGS. 4 and 5 one or more spring clips 30 are employed for attaching display plate 31 to guitar head 32. Clip 30 comprises two spring strips 33 and 34 of steel or plastic that are joined by end piece 35. Strips 33 and 34 are separated by a distance equal to the thickness of guitar head 32, and they are spring biased toward each other. Thus, strips 33 and 34 force against head 32 after they have been attached thereto, so that they securely grip the head. The width of strips 34 is small enough that they easily fit between worm gear boxes 36. End pieces 35 extend beyond the front surface of head 32 by a distance equal to or greater than the height that tuning pegs 37 extend above head 32. A strip 38 extends from each of the end pieces 35 parallel to strip 33. Display plate 31 is affixed to strips 38.

Figure 7:
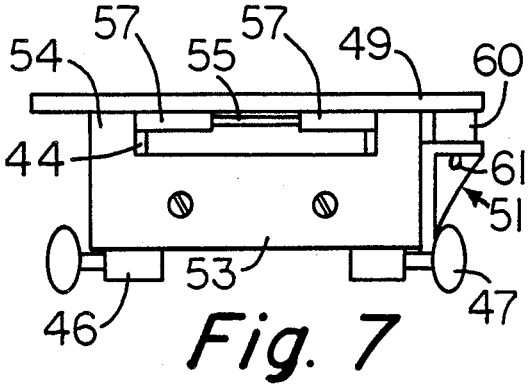
FIG. 7 is an end view of the device shown in FIG. 6.
Figure 6:
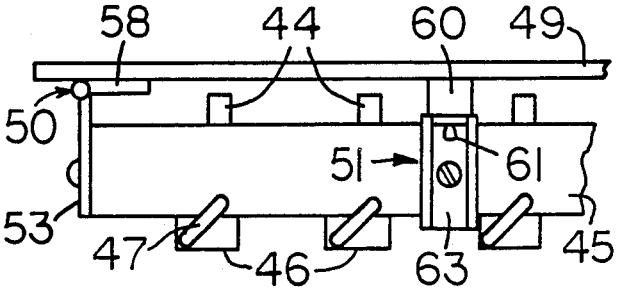
FIG. 6 shows a side view of a guitar head having a combination releasable hing and button-and-hole attachment means for securing a display sign.

In the embodiment of FIGS. 6 and 7 tuning pegs 44 protrude above guitar head 45, and a conventional worm gear arrangement 46 located opposite each tuning page 44 connects the tuning peg to a thumbscrew 47. Display plate 49 is held a predetermined distance from head 45 by connecting means including a detachable hinge 50 and a button-and-hole bracket 51. Whereas only one bracket 51 is shown, a plurality of such button-and-hole brackets may be employed for improved stability. Hinge 50 comprises a plate 53 which is affixed to the end of head 45 by screws or other suitable means. Plate 53 includes two ears 54 which anchor the ends of pin 55. A pair of resilient, semi-cylindrical clasps 57 snap into pin 55 when pressed against it in the direction of the arrow in FIG. 10. A planar member 58, which extends from clasp 57 is attached to display plate 49.

Figure 8:
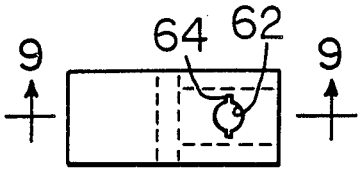
FIG. 8 is a top view of a hole-containing bracket for the button-and-hole attachment means of FIG. 6.
Figure 9:
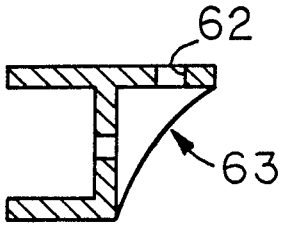
FIG. 9 is a cross-sectional view taken along lines 9—9 of FIG. 8.

The button-and-hole bracket 51 comprises a spacer member 60 having a button 61 at the bottom end thereof. Button 61 protrudes through hole 62 in bracket 63 (see FIGS. 8 and 9). The diameter of hole 62 is slightly smaller than the maximum cross-sectional area of button 61. If the button is formed of soft plastic, it will naturally deform as it passes through hole 62. If it is desirable to employ a less resilient, harder and stronger plastic, it may be necessary to provide bracket 63 with a plurality of slits 64 around hole 62, and/or provide the button with a slit as shown in FIG. 11.

Figure 10:
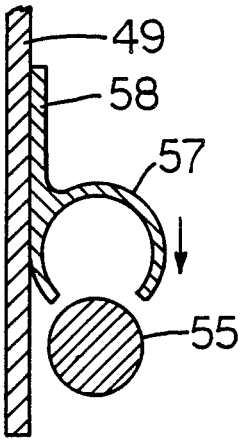
FIG. 10 illustrates the operation of the releaseable hinge of FIG. 6.

To attach the device of FIGS. 6 and 7, clasp 57 is snapped onto pin 55 as shown in FIG. 10, and display plate 49 is rotated toward face 45 until button 61 snaps through hole 62. To replace a broken string, button 61 can be removed from hole 62, and plate 49 can be rotated away from face 45. If desired, clasp 57 can be removed from pin 55 and the display plate 49 can be completely removed from the guitar.

Figure 11:
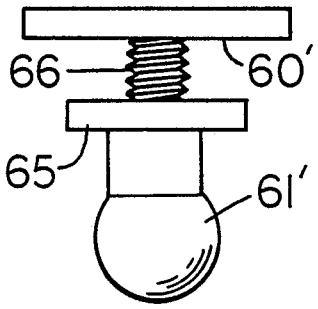
FIG. 11 is a side view of an adjustable button for use in the device of FIG. 6.

The button shown in FIG. 11 can be employed for adjusting the height of the display plate above the head. Elements similar to those illustrated in FIGS. 6 and 7 are represented by primed reference numerals. Flange 65, which is located just above button 61′, contacts bracket 63 after button 61′ snaps through hole 62. Spacer member 60′ includes a threaded member 66 which screws into a threaded bore in button 61′. Rotation of button 61′ with respect to member 60′ changes the distance between flanges 65 and member 60′.

Figure 12:
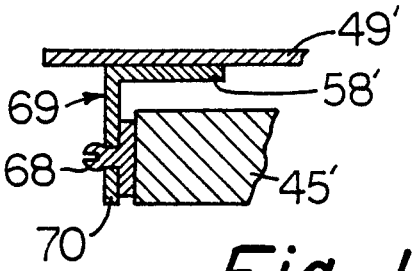
FIGS. 12 and 13 illustrate two button-and-hole attachment means that can replace the releaseable hinge of FIG. 6.
Figure 13:
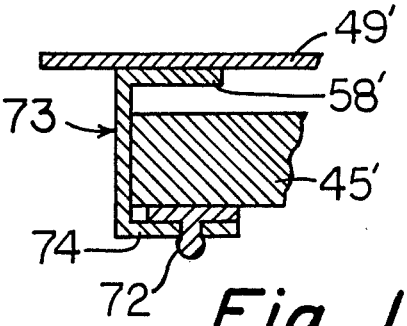

The devices illustrated in FIGS. 12 and 13 are alternative brackets which can replace hinge 50 of FIGS. 6 and 7. Elements illustrated in FIGS. 12 and 13 which are similar to those shown in FIGS. 6 and 7, are represented by primed reference numerals. In FIG. 12 a button 68 is affixed to the end of head 45′. Planar member 58′ forms a part of an L-shaped member 69. Button 68 protrudes through a hole in the remaining side 70 of L-shaped member 69. Member 69 is formed of a metal or plastic that is sufficiently resilient that plate 49′ can be lifted away from head 45′ so that button 61 does not prematurely engage bracket 63 (FIG. 6). After button 68 has been snapped through the hole in side 70, plate 49′ can be lowered toward face 45′ so that button 61 (FIG. 6a) is in position to be snapped through hole 62.

The bracket of FIG. 13 is similar to that of FIG. 12 except that button 72 is located on the back side of face 45′. Bracket 73, which is U-shaped in cross-section, is resilient so that plate 49′ can be lifted away from face 45′ until button 72 has snapped through the hole in side 74 of bracket 73. After bracket 73 is attached to button 72, attachment of plate 49′ proceeds as described in conjunction with FIG. 11.

Figure 14:
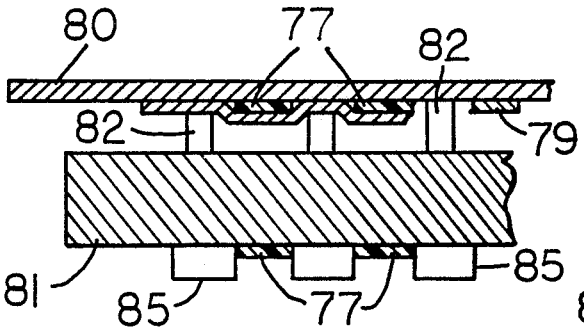
FIG. 14 is a longitudinal cross-sectional view of a guitar head having a further type of display attachment means.
Figure 15:
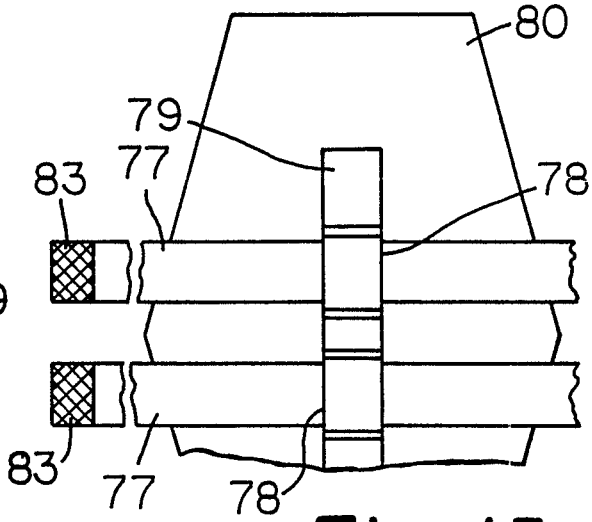
FIG. 15 is a bottom view of the display plate of FIG. 14.

In the embodiment of FIGS. 14 and 15 one or more elastic straps 77 extend through slots 78 in a bracket 79 that is attached to the back of display plate 80. Plate 80 is placed adjacent the front face of guitar head 81 such that it rests on the ends of tuning pegs 82 when strap 77 is stretched around the back of head 81. A portion of bracket 79 is broken away in FIG. 14 to show this relationship between pegs 82 and plate 80. The ends of straps 77 are provided with means such as Velcro-brand strips 83 for securing them together. Straps 77 should be narrow enough to fit between worm gear boxes 85.

Figure 16:
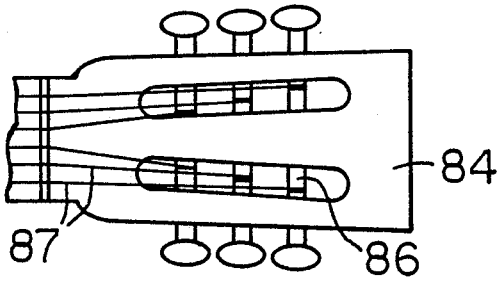
FIG. 16 is a front view of a guitar head having recessed tuning pegs.

As previously mentioned, some guitar heads, such as that illustrated in FIG. 16, contain tuning pegs 86 which are recessed in the head 84. It is obvious that a display attachment device of the type shown in FIGS. 14 and 15 would hold the display plate on the strings 87 and the front face of head 84.

Figure 20:
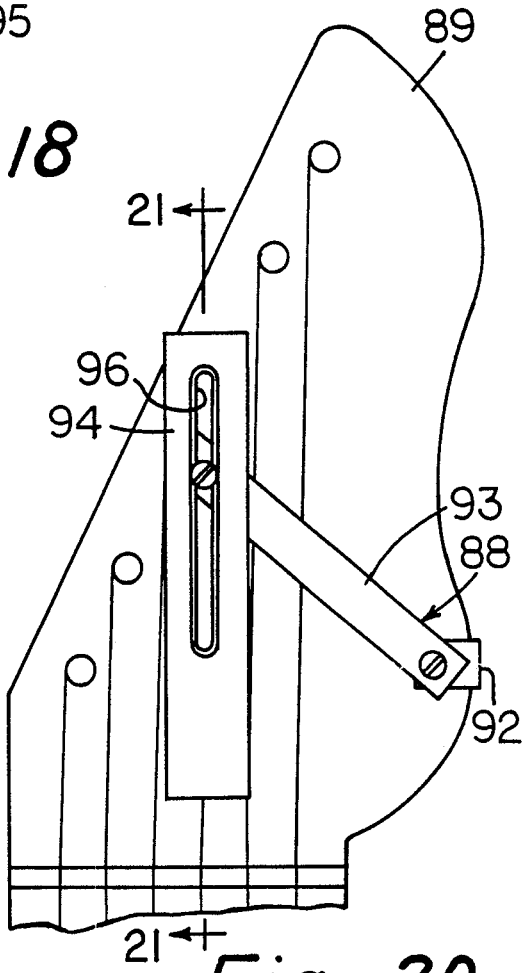
FIG. 20 shows a front view of a guitar head having affixed thereto a bracket of the type shown in FIG. 19.
Figure 21:
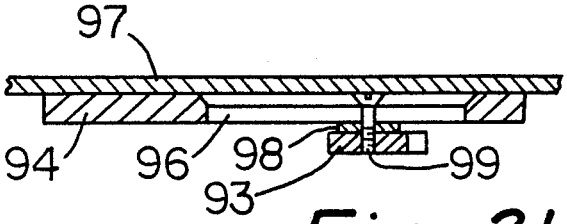
FIG. 21 is a partial cross-sectional view taken along lines 21—21 of FIG. 20.

FIGS. 17–21 show a universal bracket 88 that is especially useful for securing display plates to guitar heads such as head 89 having unusual shapes that might not accomodate some of the previously described brackets. A mounting bracket 90 is screwed or otherwise affixed to the back of head 89. Brackets 88 and 90 can be formed of plastic or metal. Bracket 88 comprises elements 91–94. Attachment element 91 has beveled edges that fit tightly into the similarly-shaped opening formed by the inwardly-angled flanges 95 of bracket 90. A U-shaped element 92 connects pivot arm element 93 to attachment element 91. The remaining end of pivot arm element 93 is connected to plate attachment element 94 which contains slot 96 that facilitates the positioning of the display plate 97 in the desired location. The leg of U-shaped element 92 extends a sufficient distance above the front face of head 89 that pivot arm element 93 is situated above the strings and tuning pegs. The angular orientation of elements 91–94 in FIG. 20 is substantially the same as the orientation thereof in FIG. 19.

Figure 17:
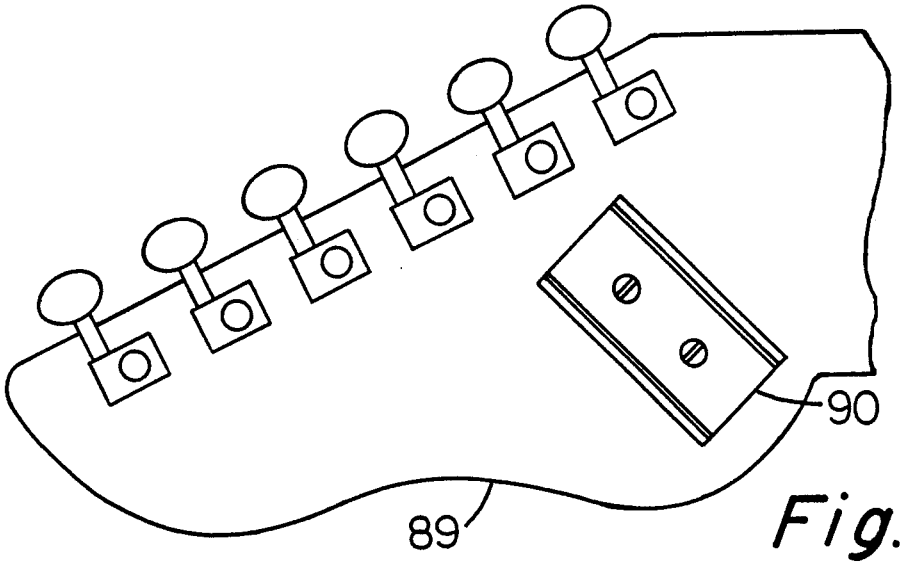
FIG. 17 shows the back of a guitar head having an attachment bracket affixed thereto.
Figure 18:
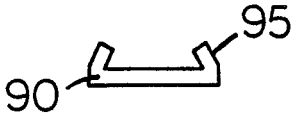
FIG. 18 is an end view of the attachment bracket employed in FIG. 17.
Figure 19:
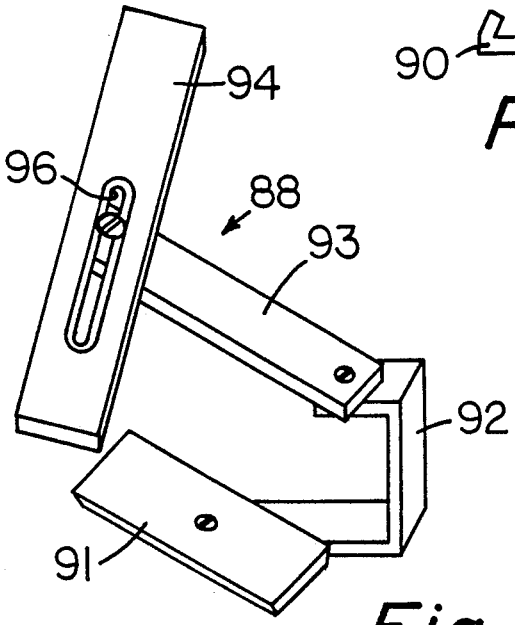
FIG. 19 is an oblique view of a universal bracket that is employed in conjunction with the attachment in FIGS. 17 and 18.

To connect the universal support bracket of FIGS. 17–21 to the guitar head, mounting bracket 90 is first attached to the back of head 89 as shown in FIG. 17. Attachment element 91 is then forced into the region between flanges 95 of bracket 90. The angles between respective ones of elements 91–94 are adjusted so that display plate 97 is located as desired. If necessary, the flat head screws interconnecting adjacent bracket elements can be tightened. The interconnection between elements 93 and 94 is illustrated in the partial cross-sectional view of FIG. 21 wherein only bracket elements above the guitar strings and tuning pegs are illustrated. Means such as sandpaper washer 98 can be employed to prevent accidential pivoting of the bracket elements. Flathead bolt 99 of FIG. 21 passes through slot 96 and is screwed into a threaded bore in element 93. The remaining pivot points of universal bracket 88 are similarly constructed. For example, a flathead bolt passes through a non-threaded bore in element 93 and screws into threaded bore in element 92. Plate 97 can be affixed to element 94 by suitable means such as double sticky tape.

I claim:

1. A display attachment device for use in combination with a stringed instrument having a neck, a head having tuning pegs, a bridge located at the junction between said neck and said head, and a string bridging the space between each of said pegs and said bridge, said attachment device comprising a display plate which overlies said strings and said tuning pegs and attachment means for releasably maintaining said plate in a position wherein it overlies said head, whereby said head and tuning pegs cannot be seen when said display attachment device is viewed from a direction perpendicular to the surface thereof.

2. A device in accordance with claim 1 further comprising means situated between said attachment means and said plate for spacing said plate a sufficient distance above said head that the surface of said plate adjacent said head is situated on or above said pegs.

3. A device in accordance with claim 2 wherein said attachment means comprises at least one strip of synthetic adherent material affixed to said head and at least one other strip of synthetic adherent material affixed to said spacing means.

4. A display device in accordance with claim 1 wherein said means for securing comprises a bracket connected to said head, the area of contact of said bracket to said head being smaller than the area of that surface of said plate that is adjacent said head.

5. A display device in accordance with claim 2 wherein said means for securing comprises a bracket connected to said head, the area of contact of said bracket to said head being smaller than the area of that surface of said plate that is adjacent said head.

6. A display attachment device for use in combination with a stringed instrument having a neck, a head having tuning pegs, a bridge located at the junction between said neck and said head, and a string bridging the space between each of said pegs and said bridge, said display attachment device comprising a display plate, attachment means for releaseably securing said plate to said head, and means situated between said attachment means and said plate for spacing said plate a sufficient distance above said head that said plate is situated on or above said pegs, said means for releasably securing comprising at least one spring clip having first and second spring strips which extend from an end piece, one of said spring strips being situated on each side of said head, said strips being spring biased toward each other such that they adhere to said head.

7. A device in accordance with claim 6 wherein said spring means comprises an extension of said end piece and a strip of material extending from said extension over said tuning pegs, said display plate being attached to said extension.

8. A display attachment device for use in combination with a stringed instrument having a neck, a head having tuning pegs, a bridge located at the junction between said neck and said head, and a string bridging the space between each of said pegs and said bridge, said display attachment device comprising a display plate, attachment means for releasably securing said plate to said head, and means situated between said attachment means and said plate for spacing said plate a sufficient distance above said head that said plate is situated on or above said pegs, said means for releasably securing comprising a hinge consisting of a first plate located at that end of said head opposite said bridge, a second plate attached to said display plate, and at least one releasable attachment device for connecting said display plate to said head at a point between said bridge and said hinge.

9. A device in accordance with claim 8 wherein said first and second hinge plates are separable.

10. A device in accordance with claim 8 wherein said at least one releasable attachment device comprises a bracket attached to a side of said head, said bracket having a hole in a flange thereof, and a button attached to said display plate, said button extending through the hole in said flange when said display plate is disposed substantially parallel to said head.

11. A display attachment device for use in combination with a stringed instrument having a neck, a head having tuning pegs, a bridge located at the junction between said neck and said head, and a string bridging the space between each of said pegs and said bridge, said display attachment device comprising a display plate, attachment means for releasably securing said plate to said head, and means situated between said attachment means and said plate for spacing said plate a sufficient distance above said head that said plate is situated on or above said pegs, said means for releasably securing comprising an L-shaped bracket having one leg thereof connected to one end of said display plate, a remaining leg of said L-shaped bracket having a hole therein, a button affixed to that end of said head opposite said bridge, and at least one releasable attachment device for connecting said display plate to said head to a point between said bridge and said L-shaped barcket, said button extending through the hole in said L-shaped bracket when said plate is secured to said head by said releasable attachment device.

12. A display attachment device for use in combination with a stringed instrument having a neck, a head having tuning pegs, a bridge located at the junction between said neck and said head, and a string bridging the space between each of said pegs and said bridge, said display attachment device comprising a display plate, attachment means for releasably securing said plate to said head, and means situated between said attachment means and said plate for spacing said plate a sufficient distance above said head that said plate is situated on or above said pegs, said means for releasably securing comprising a U-shaped bracket having one leg thereof connected to one end of said display plate, a remaining leg of said U-shaped bracket having a hole therein, and a leg joining member connecting the two legs, said leg joining member extending along that end of said head opposite said bridge, a button affixed to the back of said head opposite said bridge, and at least one releasable attachment device for connecting said display plate to said head at a point between said bridge and said U-shaped bracket, said button extending through the hole in said U-shaped bracket when said plate is secured to said head by said releasable attachment device.

13. A display attachment device for use in combination with a stringed instrument having a neck, a head having tuning pegs, a bridge located at the junction between said neck and said head, and a string bridging the space between each of said pegs and said bridge, said display attachment device comprising a display plate, attached means for releasably securing said plate to said head, and means situated between said attachment means and said plate for spacing said plate is situated on or above said pegs, said means for releasably securing comprising at least one elastic belt having first and second ends, means for releasably securing said first end of said belt to said second end thereof, and means for securing said at least one belt to said display plate, said display plate resting on the uppermost element on the face of said head when said belt extends around said head.

14. A display attachment device for use in combination with a stringed instrument having a neck, a head having tuning pegs, a bridge located at the junction between said neck and said head, and a string bridging the space between each of said pegs and said bridge, said display attachment device comprising a display plate, attachment means for releasably securing said plate to said head, and means situated between said attachment means and said plate for spacing said plate a sufficient distance above said head that said plate is situated on or above said pegs, said means for releasably securing comprising a mounting bracket affixed to the back surface of said head, a U-shaped element having first and second legs, an attachment element for connecting said first leg of said U-shaped element to said mounting bracket, a plate attachment element affixed to said display plate, and a pivot arm element connecting said plate attachment element to said second leg of said U-shaped element, said pivot arm element being pivotally connected to said plate attachment element.

15. A device in accordance with claim 14 wherein said plate attachment element has a longitudinal slot, the pivotal connection between said pivot arm element and said plate attachment element being located in said longitudinal slot.

16. A device in accordance with claim 15 wherein said pivot arm element is pivotally connected to said second leg of said U-shaped element, and said first leg of said U-shaped element is pivotally connected to said attachment element.

* * * * *